United States Patent [19]

Kupits

[11] Patent Number: 4,721,511

[45] Date of Patent: Jan. 26, 1988

[54] LEACH RESISTANT ANTIMICROBIAL FABRIC

[75] Inventor: John J. Kupits, Newtown, Pa.

[73] Assignee: W. R. Grace & Co., Cambridge, Mass.

[21] Appl. No.: 658,331

[22] Filed: Oct. 5, 1984

[51] Int. Cl.[4] ..... A61K 31/695; A61K 9/70

[52] U.S. Cl. ..... 8/188; 8/115.64; 424/404

[58] Field of Search ..... 424/28; 514/63; 8/188

[56] References Cited

U.S. PATENT DOCUMENTS

| | | | |
|---|---|---|---|
| 2,108,765 | 2/1938 | Domagk | 167/30 |
| 2,702,780 | 2/1955 | Lerner | 167/84 |
| 3,317,376 | 5/1967 | Schattner | 424/28 |
| 3,507,690 | 4/1970 | Walker | 117/139.5 |
| 3,554,952 | 1/1971 | Plueddemann | 260/29.2 |
| 3,557,178 | 1/1971 | Golitz et al. | 260/448.8 |
| 3,560,385 | 2/1971 | Roth | 252/49.6 |
| 3,624,120 | 11/1971 | Yetter | 260/448.2 |
| 3,624,224 | 11/1971 | Ling Wei et al. | 424/28 |
| 3,661,963 | 5/1972 | Pepe et al. | 260/448.2 |
| 3,699,958 | 10/1972 | Szucs | 128/146.2 |
| 3,730,701 | 5/1973 | Isquith et al. | 71/67 |
| 3,734,763 | 5/1973 | Plueddemann | 117/72 |
| 3,794,736 | 2/1974 | Abbott et al. | 424/78 |
| 3,817,739 | 6/1974 | Abbott et al. | 71/67 |
| 3,819,675 | 6/1974 | Plueddemann | 260/448.8 R |
| 3,860,709 | 1/1975 | Abbott et al. | 424/184 |
| 3,865,728 | 2/1975 | Abbott et al. | 210/169 |
| 3,876,459 | 4/1975 | Burrill | 8/127.6 |
| 3,926,896 | 12/1975 | Dumoulin | 524/397 |
| 3,956,353 | 5/1976 | Plueddemann | 260/448 |
| 3,962,500 | 6/1976 | Smith | 528/34 |
| 4,005,028 | 1/1977 | Heckert et al. | 252/99 |
| 4,143,088 | 3/1979 | Favre et al. | 525/475 |
| 4,184,004 | 1/1980 | Pines et al. | 428/413 |
| 4,259,103 | 3/1981 | Malek et al. | 71/67 |
| 4,282,366 | 8/1981 | Eudy | 556/413 |
| 4,395,454 | 7/1983 | Baldwin | 428/290 |
| 4,401,712 | 8/1983 | Morrison | 424/28 |
| 4,406,892 | 9/1983 | Eudy | 514/63 |
| 4,408,996 | 10/1983 | Baldwin | 8/490 |
| 4,411,928 | 10/1983 | Baldwin | 427/2 |
| 4,414,268 | 11/1983 | Baldwin | 428/289 |
| 4,425,372 | 1/1984 | Baldwin | 427/2 |
| 4,448,810 | 5/1984 | Westall | 427/389 |
| 4,467,013 | 8/1984 | Baldwin | 428/289 |
| 4,525,565 | 6/1985 | Laesney et al. | 528/34 |
| 4,525,566 | 6/1985 | Homan et al. | 528/34 |
| 4,529,749 | 7/1985 | Favre et al. | 523/122 |

FOREIGN PATENT DOCUMENTS

| | | | |
|---|---|---|---|
| 833513 | 2/1970 | Canada | 167/23 |
| 1386876 | 3/1975 | United Kingdom | 9/20 |

OTHER PUBLICATIONS

DuPont, "Versatile TYZOR$^R$ Organic Titanates"—Dec. 1980.

Dow Corning New Product Information Data Sheet, Jul. 29, 1980.

Dow Corning, "Information about Antimicrobial Agents", 1978.

Johannson et al., "Evidence for Chemical Bond Formation at Silane Coupling Agent Interfaces", J. Composite Materials, vol. 1 (1967), pp. 278–292.

Plueddemann, "Adhesion Through Silane Coupling Agents", 25th Annual Technical Conference, 1970, Section 13–D, pp. 1–10.

Isquith, "Surface Bonded Antimicrobial Activity of an Organosilicon Quaternary Ammonium Chloride", Applied Microbiology, Dec. 1972, pp. 859–863.

Walters et al., "Algicidal Activity of a Surface-Bonded Organosilicon Quarternary Ammonium Chloride", Applied Microbiology, Feb. 1973, pp. 253–256.

Isquith et al., "Surface Kinetic Test Method for Determining Rate of Kill by an Antimicrobial Solid", Applied and Environmental Micribiology, Nov. 1978, pp. 700–704.

Gettings et al., "A New Durable Antimicrobial Finish for Textiles", Dow Corning Bulletin #19–052–79, 1979, pp. 259–261.

*Primary Examiner*—Glennon H. Hollrah

*Assistant Examiner*—D. L. Dinner

*Attorney, Agent, or Firm*—Stacey L. Channing; William L. Baker

[57] ABSTRACT

Leach-resistant antimicrobial fabrics are provided which comprise a non-woven substrate, e.g. cellulose, polyethylene or polypropylene; a non-leachable bioactive amount of a silicone quaternary amine, preferably 3-(trimethoxysilyl)-propyloctadecyl dimethyl ammonium chloride; and an organic titanate, preferably triethanolamine titanium chelate. If alcohol and water repellency are desired properties of the fabric, then the fabric further comprises a fluorocarbon repellent with an optional fluorocarbon extender.

14 Claims, No Drawings

LEACH RESISTANT ANTIMICROBIAL FABRIC

BACKGROUND OF THE INVENTION

This invention relates to a leach resistant antimicrobial fabric and a process for making such a fabric.

A need exists for a pillow ticking, hospital gown, surgical drape or like product that provides permanent antimicrobial capacity yet the antimicrobial agent is not extracted (leached) from the fabric in use. A need also exists for such a product that is water and solvent repellent.

A particularly useful antimicrobial agent is DC-Q9-5700 available from Dow Corning Corporation of Midland, Mich. The material is a silicone quaternary amine, chemically 3(trimethoxysilyl)propyloctadecyl dimethyl ammonium chloride, and is typically supplied in a 42% solids solution. This material has been used to protect textiles and inhibit odor-causing bacteria and fungi which contamination may result in odor problems, discoloration and deterioration of these textiles. Application of this type of silicone quaternary amine onto the surface of textiles has been found to inhibit the growth of microorganisms and to aid in the control of the above-mentioned problems. As such it is authorized by the Environmental Protection Agency of the U.S. Government for use on textile surfaces (EPA No. 34292-1) and it has also been accepted by the Food and Drug Administration of the U.S. Government for use in medical device/non-drug applications for use with humans and animals.

Surgical drapes, hospital gowns, pillow ticking and like materials are typically made of non-woven textiles or other non-woven type materials. Antimicrobial agent such as DC-Q9 5700 when in dilute water solution and impregnated into a nonwoven cellulose web having an acrylic binder reacts slowly with the hydroxyl groups of the cellulose and acrylic binder because of the diluteness. When dried at 320° F. at practical machine running speeds, incomplete crosslinking takes place and the antimicrobial agent can be leached out. Crosslinking materials such as melamine formaldehyde have little or no effect on this leaching out problem. In addition, when pigment binder, such as polyvinyl alcohol, is used in conjunction with the antimicrobial agent in color (pigment) baths, the binder will leach out under the same conditions as described above. Crosslinkers such as melamine formaldehyde again have little or no effect on this leaching out problem.

Normally, a silicone quaternary amine such as DC-Q9-5700 needs a surface that has —OH funtionality, such as glass, cellulose or polyester fibers. Therefore, it has not previously been possible to apply such a silicone quaternary amine to a nonwoven substrate, such as polypropylene, which has no —OH functionality present on the fibers. Furthermore, the treatment of a nonwoven fabric with a silicone quaternary amine requires sufficient time and temperature for a proper cure in order to obtain a leach resistant product. Therefore, the treatment of low temperature melting or low temperature softening webs, such as polypropylene fiber or polyethylene fiber webs with the antimicrobial has not previously been possible.

It has previously been found that the addition of a fluoropolymer to a non-woven fabric impregnated with DC-Q9-5700 will serve to made the fabric water and alcohol-repellent. This repellency is beneficial in that the fabric can then repel body fluids, alcohol and like liquids typically present in a hospital environment.

The requirements for a successful medical fabric or substrate include the following:

1. Bioactivity-the substrate must be bioactive, that is it should be bactericidal and not merely bacteriostatic. The substrate should preferably achieve about a 95% or better bactericidal effect within one hour.

2. Non-leachibility-the bioactive material must remain on the substrate and not be leached from the substrate, but if leaching occurs it must be virtually undetectable, i.e., only less than 0.2 parts per million (0.2 ppm) from a 8½ inch×11 inch swatch. Additionally, when pigment binder is used in conjunction with the antimicrobial agent in color baths, the binder must remain on the substrate and not be leached out.

Furthermore, if water repellency is a desired property, then the fabric should be water repellent as measured by (INDA) test IST 80.7-70(R77), referred to herein as the mason jar test. In this test a swatch of sample fabric is placed over the mouth of a mason jar containing sufficient normal saline (0.9% NaCl) that when the jar is inverted a 4.5" head of water results. The top ring is screwed onto the jar, the jar is inverted and placed on a glass plate. The inverted jar is observed and the time is measured until the jar leaks. The minimum time for a successful sample is 45 minutes; however, the average time for successful samples is at least about one hour.

Accordingly, it is an object of this invention to provide a bioactive, leach-resistant nonwoven fabric.

It is a further object of this invention to provide such a fabric that is water and alcohol repellent.

It is a further object of this invention to provide such a fabric having a substrate with no OH functionality, such as polypropylene.

It is a still further object of this invention to provide such a fabric having a substrate with a low melting or softening temperature, such as polypropylene or polyethylene.

SUMMARY OF THE INVENTION

In the present invention, a leach-resistant antimicrobial fabric is provided. The fabric comprises a nonwoven substrate; a non-leachable bioactive amount of a silicone quaternary amine, such as 3-(trimethoxysilyl)-propyloctadecyl dimethyl ammonium chloride; and an organic titanate, preferably triethanolamine titanium chelate. If alcohol and water repellency are desired properties of the fabric, then the fabric further comprises a fluoropolymer repellent with an optional fluorocarbon extender. In accordance with the present invention, substrates such as cellulose, cellulose coated with acrylic latex, polypropylene, or polyethylene may be used.

DESCRIPTION OF THE PREFERRED EMBODIMENT

Leach-resistant antimicrobial fabrics are provided.

In the process of the invention, a non-woven substrate is directed from a supply reel through a pad bath (the contents of which is explained below) and passed through a nip roll and squeezed to achieve an overall wet pickup of between about 80 to 225% calculated on the weight of the non-woven substrate. The bath may alternatively be applied by spraying onto the fabric with a kiss roll or other suitable wet processing method.

Suitable non-woven substrates include among others: cellulose substrates including cellulose/polyester substrates, polyethylene substrates and polypropylene substrates. The preferred substrate is a spunbonded polypropylene available from Kimberly Clark under the Trademark Evolution II.

After the bath is applied, the impregnated substrate is dried. The impregnated substrate is preferably dried at practical machine running speeds, about 60 yards a minute, over steam heated drums at between 180° F. to 320° F. for a period of approximately 2–10 minutes. The reason for the great variation in drying temperature is due to the particular substrate used. For instance, a polyethylene substrate needs to be dried at a lower temperature than a polypropylene substrate and a polypropylene substrate in turn needs to be dried at a lower temperature than a cellulose substrate. An optional step of preliminarily drying the impregnated substrate in a hot forced air oven at about 320° F. for about 10 seconds may be employed.

The pad bath comprises water and a solids component comprising a bioactive amount of a silicone quaternary amine and an organic titanate.

The preferred silicone quaternary amine bioactive material is a 3-(trimethoxysilyl)-propyloctadecyl dimethyl ammonium chloride, available from Dow Corning Corporation of Midland, Michigan under the designation DC-5700 (formerly Q9-5700), which is described in U.S. Pat. No. 3,730,701, the disclosure of which is hereby incorporated by reference. A class of suitable bioactive silyl quaternary amine compounds have the formula:

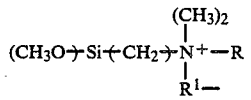

in which R is $C_{11-22}$ alkyl group and $R^1$ is chlorine or bromine.

The preferred silicone quaternary amine, 3-(trimethoxysilyl)propyloctadecyl dimethyl ammonium chloride, is preferably present in the finished fabric in an amount of from about 0.7% to about 1.05% by weight of the fabric.

Suitable organic titanates include the titanium chelates and more preferably triethanolamine titanium chelate available from DuPont under the designation Tyzor TE. Tyzor TE has the formula:

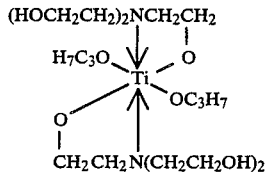

The preferred organic titanate, triethanolamine titanium chelate, is preferably present in the finished fabric in an amount of from 0.1 to about 0.75% by weight of the fabric. The organic titanate, when added in a proportion of 5 to 15% of the solution nonvolatiles acts as a catalyst and will crosslink the antimicrobial agent rendering it completely unleachable. In addition, the organic titanate has a dramatic effect in completely eliminating the leaching of pigment binder when pigment binder is used in conjunction with the antimicrobial agent in color baths.

Not only does the addition of an organic titanate result in more complete crosslinking of the antimicrobial agent and optionally the pigment binder but it also serves to significantly reduce the time and temperature required in processing to obtain a leach resistant product, thus making suitable previously unsuitable low temperature melting and low temperature softening webs such as polypropylene and polyethylene. Furthermore, by adding an organic titanate catalyst, the problem of binding the silicone quaternary amine to a surface that has no OH functionality, such as polypropylene, is avoided.

If a polypropylene or polyethylene substrate is used, the bath preferably further comprises a wetting agent for the fibers, such as isopropanol.

If alcohol and water repellency are desired properties of the fabric, then the bath preferably further comprises a fluorocarbon repellent with an optional fluorocarbon extender. The fluorocarbon repellent component is typically a dispersion of fluoropolymer in water. The fluorocarbon repellent component may be selected from a host of commercially available products including 3M's FC-824, FC-831 and FC-461 and DuPont's Zepel K, Zepel RN, Zepel RS and Zonyl NWF. One will select a fluorocarbon component that is compatible with the system, i.e. the other bath components and processing conditions, is economical and provides the required alcohol repellency. As the fluorocarbon component is more expensive than the wax/resin fluorocarbon extender described below, it is desirable to use the smallest amount of the more expensive component as possible.

The wax/resin component is well known in the art as a fluorocarbon extender. These materials are typically available in emulsions with a cationic or nonionic emulsifier. Suitable wax/resin fluorocarbon extenders commercially available include: Aerotex Repellent 96 a water dispersible wax resin containing reactive nitrogenous compounds available from American Cyanamid; Norane 193, a high molecular weight hydrophobic resin wax complex, and Norane 88, both available from Sun Chemical Company; and Nalan W, a thermosetting resin condensate and Nalan GN, a polymer wax dispersion, both available from DuPont. The wax/resin extender provides the finished fabric with the water repellency desired, serves to stabilize the silicone quaternary amine present in the bath and of course, allows for a reduction in the amount of the more expensive fluorocarbon repellent component.

When a fluorocarbon repellent component is added to the bath, other materials besides the fluorocarbon extender, such as sodium acetate, citric acid, Avitex 2153 obtained from DuPont, or Synthrapol KB, obtained from DuPont, can be added to the bath in order to stabilize the bath.

A minor amount of monovalent salt, typically sodium chloride, may be added to the bath in order to enhance the antistatic property of the finished fabric. Suitable salts include sodium dihydrogen phosphate and sodium chloride; divalent salts such as calcium chloride should not be used. The salt when present in the finish accepts moisture from the surrounding atmosphere and readily ionizes, thus enhancing the antistatic properties of the fabric. The required amount of salt is dissolved in water and then added to the bath.

The fabric produced in accordance with the present invention will be bioactive, leachable only to the extent of at most 0.2 ppm from a 8½ inch by 11 inch swatch, and if water and alcohol repellency is a desired quality, will be water repellant as measured by at least a 45 minute test value and preferably a one hour test value according to the mason jar test.

The invention is further illustrated by the following non-limiting example:

EXAMPLE 1

Two nonwoven cellulose webs coated with an acrylic latex (Goodrich 2600×120) were each wet impregnated at 150% with saturant A containing 2.87% total solids. Two similar cellulose webs were each similarly impregnated with saturant B containing 2.87% total solids and two more similar cellulose webs were each similarly impregnated with saturant C containing 2.87% total solids, the compositions of A, B and C being given below in grams.

| | A (grams) | B (grams) | C (grams) |
|---|---|---|---|
| Water | 1600 | 1600 | 1600 |
| Polyvinyl alcohol | 1664 | 1664 | 1664 |
| Water | 2700 | 2700 | 2700 |
| pigments | 30.72 | 30.72 | 30.72 |
| Water | 260 | 260 | 260 |
| Q9-5700 | 116 | 116 | 116 |
| Water | 160 | 160 | 160 |
| UCARSIL-50SL [a silicone wetting agent available from Union Carbide] | 80.8 | 80.8 | 80.8 |
| Water | 1342 | 1342 | 1392 |
| Tyzor TE | 8.3 | 24.9 | — |
| Water | 50 | 50 | — |
| | 8011.82 | 8028.42 | 8003.52 |

The impregnated webs were then dried at various temperatures for various amounts of time. Each web was then immersed in a water solution containing 0.9% salt for one hour and then tested for any leaching out of color. The results were as follows:

| | Color Fastness in water Dried 320° F. 5 minutes | Dried 300° F. 5 minutes |
|---|---|---|
| A | satisfactory | satisfactory |
| B | satisfactory | satisfactory |
| C | satisfactory | satisfactory |
| | **Color Fastness in water Dried 260° F. 5 minutes** | **Dried 260° F. 2 minutes plus air dry one hour** |
| A | satisfactory | leaches color |
| B | satisfactory | satisfactory |
| C | satisfactory | leaches color |

EXAMPLE 2

A nonwoven spunbonded polypropylene web (Evolution II) obtainable from Kimberly Clark was wet impregnated at 150° F. with saturant G containing 2.54% total solids. The composition of saturant G is given below in grams.

| | G |
|---|---|
| Water | 500 |
| Isopropanol | 45 |
| Water | 50 |
| Sodium Acetate | 2 |
| Citric Acid | 0.5 |
| Aerotex 96 | 40 |
| Water | 50 |
| FC 824 | 7.5 |
| Water | 50 |
| Q9 5700 | 14 |
| Water | 50 |
| Tyzor TE | 5 |
| Water | 50 |
| Water | 136 |
| | 1000 grams |

The impregnated web was then dried at 225° F. for 5 minutes. The percent solids in the fabric were 3.81% of which 23.17% was Q9-5700, 11.82% was FC 824, 39.40% was Aerotex 96, 15.76% was Tyzor TE, 7.88% was sodium acetate and 1.97% was citric acid.

EXAMPLE 3

A nonwoven perforated polyethylene web (Tyvek 1621C obtainable from DuPont) and a nonwoven polyethylene web (Tyvek 1422 obtainable from DuPont) were wet impregnated at 150% with saturant G from Example 2. The impregnated webs were then dried at 225° F. for 5 minutes. Due to the fact that it was a perforated material, the Tyvek 1621 C Fabric had no holdout of liquid in the mason jar test and was thus unsatisfactory.

EXAMPLE 4

A nonwoven polyethylene web Tyvek 1422 was wet impregnated at 100% with saturant containing 3.81% total solids and having the following composition in grams:

| | SATURANT (grams) |
|---|---|
| Water | 450.0 |
| Isopropanol | 40.0 |
| Water | 60.0 |
| Water | 20.0 |
| Sodium acetate | 3.0 |
| Water | 20.0 |
| Citric acid | 0.8 |
| Aerotex 96 | 60.0 |
| FC 824 | 11.3 |
| Water | 50.0 |
| Q9-5700 | 21.0 |
| Water | 50.0 |
| Tyzor TE | 7.5 |
| Water | 50.0 |
| Water | 96.4 |
| | 1000 |

The impregnated web was then dried at 225° F. for 5 minutes. The fabric was water repellent as measured by a 2 hour plus mason jar test.

EXAMPLE 5

A nonwoven polyethylene web Tyvek 1422 was wet impregnated at 100% with saturant containing 1.48% total solids and having the following composition in grams:

| | SATURANT (grams) |
|---|---|
| Water | 450.0 |

-continued

| | SATURANT (grams) |
|---|---|
| Isopropanol | 40.0 |
| Water | 60.0 |
| Q9-5700 | 21.0 |
| Water | 50.0 |
| Tyzor TE | 7.5 |
| Water | 50.0 |
| Water | 321.5 |
| | 1000 |

The impregnated web was then dried at 225° F. for 5 minutes.

EXAMPLE 6

A nonwoven spunbonded polypropylene web (Blue Evolution II from Kimberly Clark) was wet impregnated at 150% with Saturant D and another nonwoven spunbonded polypropylene web (Blue Evolution II) was wet impregnated at 150% with Saturant E containing 3.10% total solids. The compositions of saturant D and E are given below in grams.

| | D (grams) | E (grams) |
|---|---|---|
| Soft water (water treated to remove minerals) | 2500 | 2500 |
| Avitex 2153 | 6.2 | 4.0 |
| Soft Water | 30 | 30 |
| Synthrapol KB | 6.2 | 4.0 |
| Soft Water | 30 | 30 |
| Citric Acid | 8.4 | 5.6 |
| Soft Water | 30 | 30 |
| Nalan W | 412 | 309 |
| Soft Water | 150 | 150 |
| Soft Water | 2300 | 2300 |
| Zepel K | 824 | 618 |
| Soft Water | 300 | 300 |
| Q9-5700 | 224 | 120 |
| Soft Water | 440 | 300 |
| Tyzor TE | 80 | 30 |
| Soft Water | 400 | |
| Soft Water | 299.2 | 1270 |
| | 8000 | 8000 |

The impregnated webs were then dried at 260° F. for 5 minutes. The web impregnated with Saturant E gave satisfactory mason jar test values.

EXAMPLE 7

A nonwoven polypropylene web (Blue Evolution II from Kimberly Clark) was wet impregnated at 200% with Saturant H containing 4.56% total solids and having the following composition in grams:

| | Saturant H (grams) | % of total solids |
|---|---|---|
| Soft water | 2500 | 0.20 |
| Avitex 2153 | 2.4 | |
| Soft water | 30 | |
| Synthrapol KB | 2.4 | 0.66 |
| Soft water | 30 | |
| Sodium chloride | 4.8 | 1.32 |
| Soft water | 30 | |
| Citric acid | 4.5 | 1.23 |
| Soft water | 30 | |
| Nalan W | 880 | 60.32 |
| Soft water | 150 | |
| Soft water | 2300 | |
| Zepel K | 520 | 19.96 |

-continued

| | Saturant H (grams) | % of total solids |
|---|---|---|
| Soft water | 300 | |
| Q9-5700 | 96 | 11.05 |
| Soft water | 300 | |
| Tyzor TE | 24 | 5.26 |
| Soft water | 795.9 | |
| | 8000 | 100% |

The impregnated web was then dried at 260° F. for 5 minutes. The fabric had a 57 minute mason jar test value. When the formula of Saturant H was dropped from 4.56% total solids to 4% total solids, it resulted in an unsatisfactory mason test value.

EXAMPLE 8

A nonwoven polypropylene web (Blue Evolution II from Kimberly Clark) was wet impregnated at 200% with Saturant L containing 3.28% total solids and having the following composition in grams:

| | Saturant L (grams) | % of total solids |
|---|---|---|
| Soft water | 2500 | |
| Avitex 2153 | 2.4 | 0.28 |
| Soft water | 30 | |
| Syntrapol KB | 2.4 | 0.94 |
| Soft water | 30 | |
| Sodium chloride | 4.8 | 1.88 |
| Soft water | 30 | |
| Citric acid | 4.5 | 1.77 |
| Soft water | 30 | |
| Aerotex 96 | 440 | 43.18 |
| Soft water | 150 | |
| Soft water | 2300 | |
| Zepel K | 520 | 28.58 |
| Soft water | 300 | |
| Q9-5700 | 96 | 15.83 |
| Soft water | 300 | |
| Tyzor TE | 24 | 7.54 |
| Soft water | 695 | |
| Isopropanol | 140 | |
| Soft water | 200 | |
| Soft water | 200.9 | |
| | 8000 | 100% |

The impregnated web was then dried. The fabric has a mason jar test value of 2 hours plus.

While this invention has been described with reference to its preferred embodiment, other embodiments can achieve the same result. Variations and modifications of the present invention will be obvious to those skilled in the art and it is intended to cover in the appended claims all such modifications and equivalents as fall within the spirit and scope of this invention.

I claim:

1. A bioactive, water-repellent, alcohol-repellent fabric comprising:

a non-woven polypropylene substrate;

from about 0.7 to about 1.05% by weight of non-leachable 3-(trimethoxysilyl)-propyloctadecyl dimethyl ammonium chloride;

from about 0.1 to about 0.75% by weight of triethanolamine titanium chelate; and an alcohol and saline-repelling amount of a fluoropolymer repellent.

2. The bioactive fabric of claim 1 which:

(a) is leachable only to the extent of at most 0.2 ppm from an 8½ in. by 11 in. swatch and (b) is water repellent, as measured by at least a 45 minute test value according to the mason jar test.

3. The bioactive fabric of claim 1 further comprising a polypropylene wetting agent.

4. The bioactive fabric of claim 3 wherein the polypropylene wetting agent comprises isopropanol.

5. A bioactive fabric comprising:

a non-woven substrate selected from the group consisting of polypropylene and polyethylene;

from about 0.7 to about 1.05% by weight of an alkoxy silicone quaternary amine; and from about 0.1 to about 0.75% by weight of triethanolamine titanium chelate.

6. The bioactive fabric of claim 5 wherein the alkoxysilane quaternary amine comprises 3-(trimethoxysilyl)-propyloctadecyl dimethyl ammonium chloride.

7. The bioactive fabric of claim 5 wherein the alkoxysilane quaternary amine has the formula:

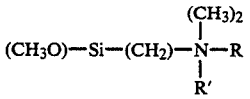

wherein R is a $C_{11-22}$ alkyl group and R′ is chlorine or bromine.

8. The bioactive fabric of claim 5 wherein said fabric further comprises an alcohol and saline-repelling amount of a fluoropolymer repellent.

9. The bioactive fabric of claim 5 wherein said fabric further comprises a wetting agent for the non-woven substrate.

10. A bioactive fabric comprising:

a non-woven cellulosic substrate;

from about 0.7 to about 1.05% by weight of 3-(trimethoxysilyl)-propyloctadecyl dimethyl ammonium chloride;

from about 0.1 to about 0.75% by weight of triethanolamine titanium chelate;

pigment; and pigment binder.

11. The bioactive fabric of claim 10 wherein the pigment binder comprises polyvinyl alcohol.

12. The bioactive fabric of claim 10 wherein the cellulosic substrate is coated with an acrylic latex.

13. The bioactive fabric of claim 10 further comprising a silicone wetting agent.

14. The bioactive fabric of claim 10 further comprising an alcohol and saline-repelling amount of a fluoropolymer repellent.

* * * * *